US008439026B1

(12) United States Patent
Kilian

(10) Patent No.: US 8,439,026 B1
(45) Date of Patent: May 14, 2013

(54) MECHANICAL FULL DRAW, HOLD, LOCK AND ARROW RELEASE DEVICE FOR COMPOUND BOWS

(76) Inventor: Frederick R. Kilian, Webster, NY (US)

( * ) Notice: Subject to any disclaimer, the term of this patent is extended or adjusted under 35 U.S.C. 154(b) by 12 days.

(21) Appl. No.: 13/374,832

(22) Filed: Jan. 17, 2012

(51) Int. Cl.
*F41B 5/18* (2006.01)

(52) U.S. Cl.
USPC ..... 124/35.2; 124/86

(58) Field of Classification Search ..... 124/23.1, 124/24.1, 25.6, 35.2, 86, 88
See application file for complete search history.

(56) References Cited

U.S. PATENT DOCUMENTS 3,895,621 A * 7/1975 Kellogg ..... 124/24.1
4,603,676 A * 8/1986 Luoma ..... 124/25
4,919,107 A * 4/1990 Bunts ..... 124/24.1
5,000,154 A * 3/1991 Slayton ..... 124/23.1
5,065,730 A * 11/1991 Kluver ..... 124/35.2
5,465,705 A * 11/1995 Baeseman ..... 124/88
5,671,723 A * 9/1997 Goff et al. ..... 124/35.2
5,944,004 A * 8/1999 Goff et al. ..... 124/35.2
6,012,440 A * 1/2000 Grindle ..... 124/86
6,968,836 B1 * 11/2005 Kees ..... 124/35.2

* cited by examiner

*Primary Examiner* — John Ricci

(57) ABSTRACT

The invention comprises a lever support arm tube attached perpendicular at one end to a compound bow and at the other end has an attached pulley assembly. Attached in between is a shoulder rest assembly, a lever arm hinged at the tube and a slip-lock ring. The draw cable attached to a quick release aid holding the bow string passes back around the pulley assembly and passes forward to the lever arm hinged backwards toward the pulley assembly. The archer forces the lever arm forward, pulling the draw cable around the pulley assembly thereby drawing the bow string. The archer engages the slip-lock ring holding the lever arm to maintain the bow string in the full draw position. An arrow is nocked. The archer's left hand aims the bow. The right shoulder supports the invention using the shoulder rest assembly. The right hand pulls the quick release aid trigger.

8 Claims, 3 Drawing Sheets

MECHANICAL FULL DRAW, HOLD, LOCK AND ARROW RELEASE DEVICE FOR COMPOUND BOWS

BACKGROUND OF THE INVENTION

The compound bow was first developed in 1966 by Holless Wilber Allen in Missouri, and a US patent was granted in 1969. The compound bow is a modern bow that uses a levering system, usually of cables and pulleys, to bend the limbs. The use of this levering system "gives" as the compound bow is drawn, producing a characteristic draw-force curve which rises to a peak draw weight and then "lets off" a certain percentage of the peak draw weight as the draw continues to a full draw condition. The let-off is usually between 65% and 80% of the peak draw weight. Since the draw weight can range by as much as 30 to 100 pounds, this factor alone contributes to the physical capabilities that an archer must possess to participate in the sport of compound bow shooting. Not all potential archers have these physical capabilities. They can neither achieve the bow string draw nor hold the bow string draw until the arrow is on target and released. Still other archers have the physical capabilities but because of the fatigue factor or the desire to improve accuracy want a device to assist them with drawing and holding the bow string until the arrow is on target and released.

For many years archers have used draw-locks of various types, including the locking mechanisms used in crossbows. For compound bows, a draw-lock has generally been either a fixed rod along which the bowstring is drawn or a moveable rod drawn along with the bowstring. Both types use some sort of latch mechanism to lock the bowstring at full draw and a release mechanism to release the bowstring and propel the arrow.

This invention deals with the same general compound bow problem of mechanically drawing, holding, locking and releasing the arrow to relieve the archer of the physical capabilities required to perform these acts. This invention solves all these problems by employing a simple, easy to install second class lever mechanism that requires minimal strength to fully draw, hold, lock and release the arrow.

FIELD OF THE INVENTION

The present invention relates to the general field of compound bow accessories and to the more specific field of a mechanical full draw, hold, lock and arrow release device for compound bows.

PRIOR ART

Prior art search included review of prior art published on the various search engines. Further, a USPTO patents and published applications search in US classifications 124/88; 124/86; 124/35.2; 124/25; 124/24.1 and 124/23.1 was performed. No prior art similar to this unique and nonobvious invention was found.

BRIEF SUMMARY OF THE INVENTION

For years archers have used various devices to assist them with drawing and holding bow strings until the arrow is released. Cross bows, long bows, recurve bows and now compound bows have been the object of these inventive configurations. This unique and nonobvious invention which is designed for compound bows solves the problem by enabling the archer with a simple easy to install second class lever mechanism that requires minimal strength to fully draw the bow string, hold it, lock it, nock the arrow, aim and release the arrow.

This invention is comprised of a lever support arm tube (1) attached perpendicular at one end to a generic compound bow (10) and attached to it at the other end a pulley assembly (7). In between, attached to the lever support arm tube (1) is a shoulder rest assembly (4), a lever arm (2) hinged at the lever support arm tube (1) and a slip-lock ring (8). A draw cable (13) attached to a generic quick release aid (12) holding the generic bow string (11), passes back to the pulley assembly (7), rolling over pulley wheels, reversing direction and attaching forward to the lever arm (2) at the lever arm eyelet (20). With the generic bow string (11) held by the generic quick release aid (12), the archer establishes the at rest position by holding and gently pushing the lever arm (2) forward in the direction of the generic compound bow (10), pulling taut the draw cable (13). In this at rest position the lever arm (2) is angled backwards in the direction of the pulley assembly (7) forming an acute angle with the lever support arm tube (1). See the primary view in Sheet 1/3, FIG. 1.

Best mode operation of this invention begins when the archer, exposing the quick release aid trigger on the right side of the bow, connects the generic quick release aid (12) to the generic bow string (11). Next, the archer holds the lever arm (2) by the outboard end in the at rest position and forces it forward in the generic compound bow (10) direction. When the lever arm is in the at full draw position flat against the lever support arm tube (1), the archer slides the slip-lock ring (8) over the end of the lever arm (2) and between the two lever arm ridges on the end of the lever arm (2). The generic bow string (11) has now moved the full previously adjusted full draw length amount and is locked in this position. The archer nocks an arrow. The generic compound bow (10) is held and aimed using the left hand. The invention rests on the archer's right shoulder, supported by the shoulder rest frame & pad (4). The right hand is free to pull the generic quick release aid trigger (12).

Four adjustments optimize compound bow best mode performance enabled by this invention. The first adjustment sets the draw cable alignment such that the generic quick release aid (12) holding the generic bow string (11) is drawn back on a line parallel to the lever support arm tube (1) axis. The second adjustment eliminates draw cable binding on the pulley assembly (7) pulleys by rotating the lever arm (2) relative to the lever support arm tube (1) axis to set the draw cable attached to the lever arm (2) in line with the pulley assembly (7) pulleys. The third adjustment changes the full draw length amount. Two ways are available to accomplish this. One way is to move the lever arm hinge sleeve (3) along the lever support arm tube (1) axis. The other way is to move the lever arm eyelet (20) to another hole location on the lever arm (2). This adjustment also changes the second class lever advantage. The forth adjustment changes the shoulder rest frame & pad (4) to fit ergonomically the physical characteristics of the archer relative to the invention.

BRIEF DESCRIPTION OF THE DRAWINGS

The three drawing sheets represent right hand use of the invention. Left hand use of the invention requires a minor change to the connection plate (9) and a 180 degree rotation of the generic quick release aid (12) when holding the generic bow string (11).

Sheet 1/3.

Sheet 2/3.

Sheet 2/3.

Sheet 3/3, FIG. 4 is a view of the archer holding and forcing the lever arm forward in the direction of the generic compound bow, pulling the draw cable around the pulley assembly, pulling the generic quick release aid, thereby pulling the attached generic bow string to an at full draw position. In FIG. 5 the lever arm is in the at full draw position. The archer is locking the lever arm in place with the slip-lock ring. In FIG. 6 the archer is nocking an arrow with the right hand and holding the generic compound bow with the left hand. In FIG. 7 the archer is holding the compound bow in the left hand, resting the invention on the right shoulder with the invention shoulder rest assembly, aiming and pulling the generic quick release aid trigger with his right hand.

DETAILED DESCRIPTION OF THE INVENTION

A detailed description of the invention use begins with Sheet 3/3, FIGS. 4 through 7 clearly demonstrating the enablement and best mode functionality of this unique invention. These four drawings are tracings made from photographs of an archer operating an engineering model of the invention.

Figure 4:
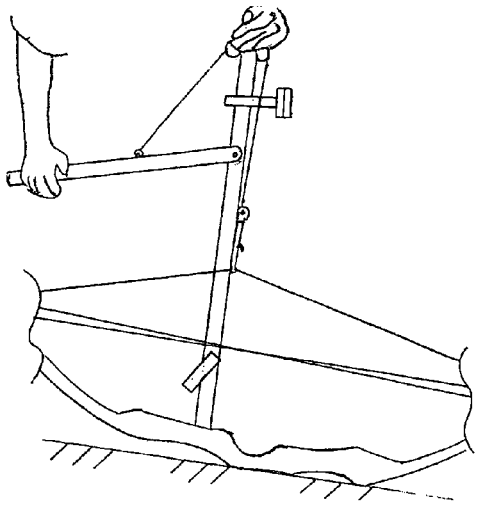

FIG. 4 is a view of the archer holding the invention just above the pulley assembly (7) with the left hand and pushing down on the lever arm (2) with the right hand forcing the lever arm (2) forward in the direction of the generic compound bow (10). This action pulls the draw cable (13) around the pulley assembly (7), pulling the generic quick release aid (12), thereby pulling the generic bow string (11) to an at full draw position. The second class mechanical advantage of the lever arm (2) assists the archer pushing the lever arm (2) in the direction of the generic compound bow (10).

Figure 5:
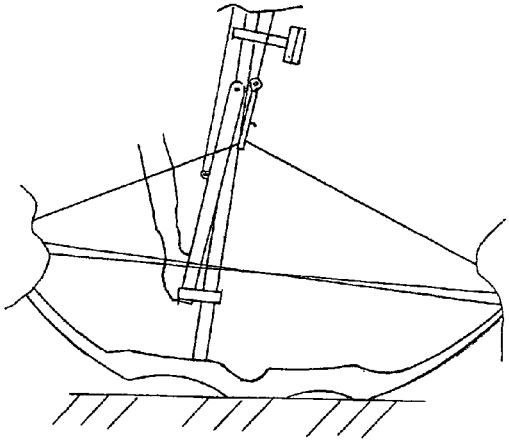
FIGS. 4 through 7 are tracings made from photographs of an archer enabled with an engineering model of the invention.

In the next view, FIG. 5, the lever arm (2) is at the at full draw position. The archer's right hand moves the slip-lock ring (8) over the end of the lever arm (2) in between the two lever arm ridges. These ridges are clearly visible on the open end of the lever arm (2) in FIGS. 1 and 2. The generic bow string (11) is now held and locked in the at full draw position.

The slip-lock ring (8) will NOT slip off of the lever arm (2). The in-tension, fully drawn generic bow string (11) transfers this tension to the draw cable (13) which, in turn, transfers this tension back around the pulley assembly (7) and forward to the lever arm (2) eyelet (20), slightly lifting and pressing the lever arm (2) against the slip-lock ring (8), thus wedging it between the two ridges.

Figure 6:
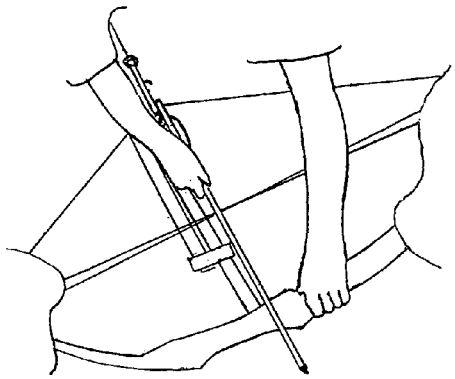

In FIG. 6 the archer grips the generic compound bow (10) at the bow handle with the left hand and nocks an arrow with the right hand. The compound bow enabled with this invention is ready to shoot the arrow.

Figure 7:
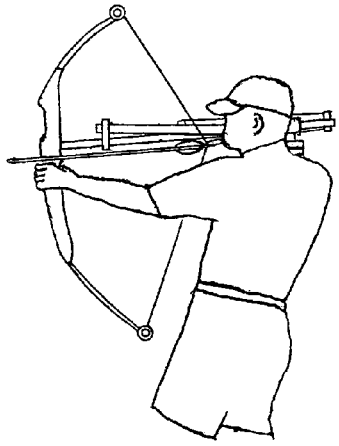

In FIG. 7 the archer holds the generic compound bow (10) in the left hand and aims at the target. The shoulder rest frame & pad (4) supports the configuration on the archer's right shoulder. The archer's right hand is free to pull the generic quick release aid (12) trigger at will.

Figure 1:
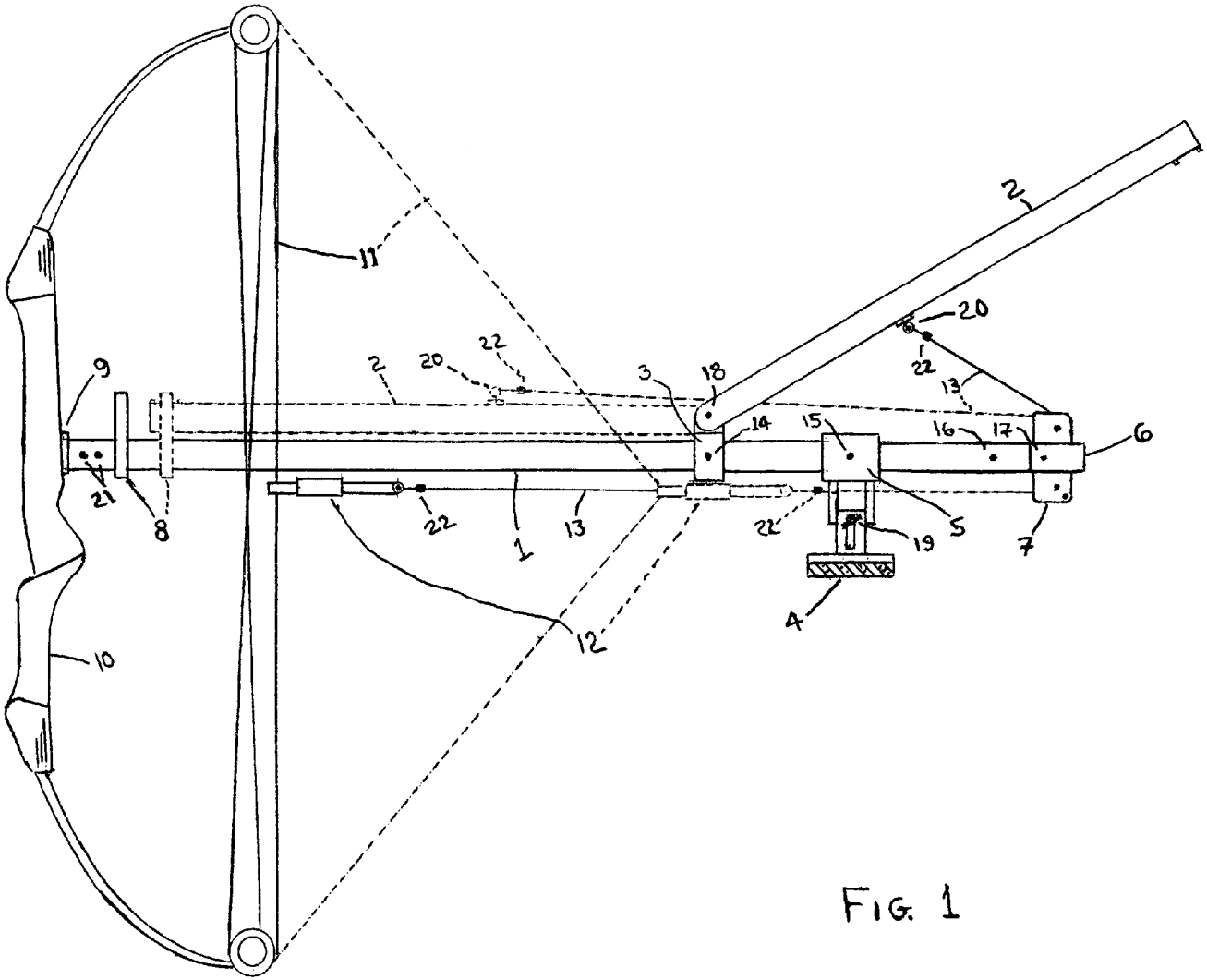
FIG. 1 is a side view of the invention showing both a primary and alternate view. In the primary view, the lever arm (2) and bow string (11) are at rest position. In the alternate view, the lever arm (2) and the bow string (11) are at full draw position and locked.
Figures 2, 3:
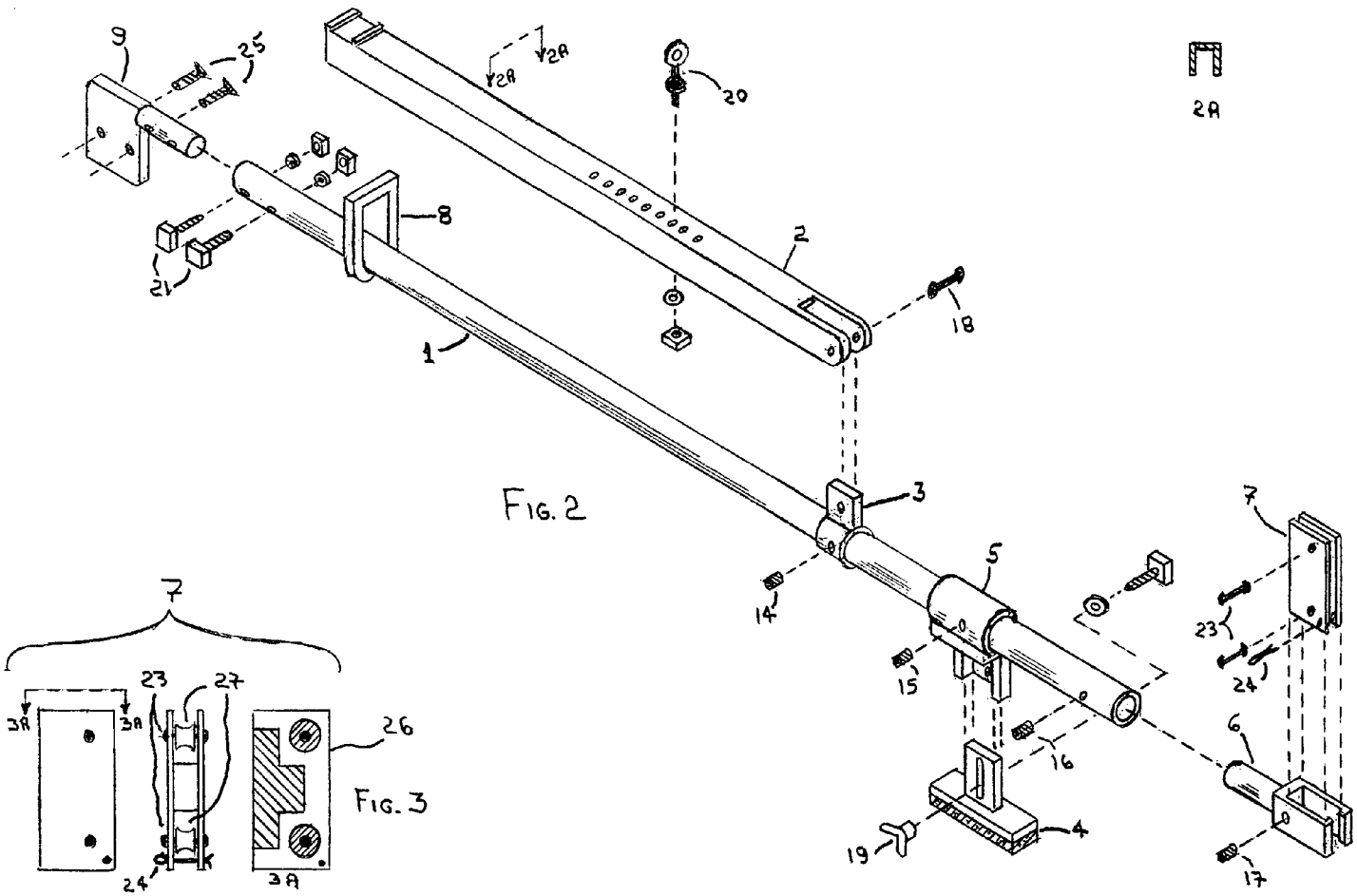
FIG. 2 is also a side view of the invention but it is in a three dimension "goes-into" format. The generic bow (10), generic bow string (11), generic quick release aid (12) and the draw cable (13) are omitted from FIG. 2.
FIG. 3 is a detailed drawing of the pulley assembly (7) in three views.

The parts and assembly details of the invention are delineated in Sheet 1/3, FIG. 1 and Sheet 2/3, FIG. 2 and FIG. 3. In total there are 27 numbered parts and assemblies comprising this invention. They are individually listed as follows:

1-Lever support arm tube
2-Lever arm
3-Lever arm hinge sleeve
4-Shoulder rest frame & pad (adhesive joined)
5-Shoulder rest adjustment sleeve
6-Pulley assembly swivel
7-Pulley assembly
8-Slip-lock ring
9-Connection plate
10-Generic compound bow
11-Generic bow string
12-Generic quick release aid
13-Draw cable
14 through 17-Four set screws
18-Rivet
19-Bolt, washer & wing nut
20-Eyelet, washer & nut
21-Two bolts, washers & nuts
22-Two ferrules
23-Two rivets
24-Cotter pin
25-Two flat head screws
26-Pulley assembly frame
27-Two pulley wheels Three phrases are uniquely used in this application. They are in bold and in italics.

The at rest position is the primary view in FIG. 1. The generic quick release aid (12) is connected to the generic bow string (11). The draw cable (13) is taut. The lever arm (2) is leaning back toward the pulley assembly (7) to form an acute angle with the lever support arm tube (1).

The at full draw position is the alternate position in FIG. 1. The lever arm is flat against the lever support arm tube (1) and held in place by the slip-lock ring (8). The generic bow string (11) is held in the at full draw position by the generic quick release aid (12).

The full draw length is the distance traveled by the generic bow string (11) nock position from the at rest position to the at full draw position.

Sheet 1/3, FIG. 1 and Sheet 2/3, FIGS. 2 and 3 together provide a total description of the invention detail. Sheet 1/3, FIG. 1 is shown in a primary view with the lever arm (2) in the at rest position and it is also shown in the alternate view with the lever arm (2) in the at full draw position, held and locked.

The Sheet 1/3, FIG. 1, the at rest position is set up by attaching the generic quick release aid (12) to the generic bow string (11). The draw cable (13) attached to the other end of the generic quick release aid (12) passes back to the pulley assembly (7), rolling over pulley wheels, reversing direction and attaching forward to the lever arm (2) at the lever arm eyelet (20). The archer holds and gently pushes the lever arm (2) forward in the generic compound bow (10) direction, pulling taut the draw cable (13). In this at rest position the lever arm (2) is angled backwards in the direction of the pulley assembly (7) to form an acute angle with the lever support arm tube (1).

When the archer pulls the lever arm (2) in the direction of the generic compound bow (10) from the at rest position to the at full draw position, the generic bow string (11) travels the then established full draw length amount. The amount of the acute angle previously described establishes this full draw length amount. A smaller acute angle produces a longer full draw length amount. Conversely, a larger acute angle produces a shorter full draw length amount.

There are two ways to adjust the acute angle in the at rest position.

The first way involves adjusting the lever arm hinge sleeve (3) location. The acute angle is changed by loosening the lever arm hinge sleeve (3) set screw (14) and sliding the lever arm hinge sleeve (3) along the lever support arm tube (1) axis. Sliding the lever arm hinge sleeve (3) in the direction of the generic compound bow (10) decreases the acute angle and increases the preset full draw length amount. A note of caution: when sliding the lever arm sleeve (3) in the direction of the generic compound bow (10), allow room for the slip-lock ring (8) to engage the lever arm (2) in the at full draw position.

Sliding the lever arm hinge sleeve (3) in the other direction, away from the generic compound bow (10), increases the acute angle and decreases the preset full draw length amount.

When it is estimated the desired acute angle in the at rest position is achieved, tighten set screw (14). Move the lever arm (2) from the at rest position to the at full draw position. Examine if a satisfactory full draw length amount is achieved. If the desired amount is not achieved, release the lever arm (2) SLOWLY to release the draw cable (10) tension and repeat the adjustment sequence.

The second adjustment is achieved by relocating the eyelet, washer & nut (20) to another hole on the lever arm (2). See Sheet 2/3, FIG. 2, for a view of the lever arm (2) hole positions. Locating the eyelet, washer & nut (20) to a hole closer to the lever arm hinge decreases the acute angle and decreases the full draw length amount. This adjustment increases the lever arm (2) second class lever mechanical advantage. Locating the eyelet, washer and nut (20) to a hole further away from the lever arm hinge increases the acute angle and increases the full draw length amount. This adjustment decreases the lever arm (2) second class lever mechanical advantage.

The lever support arm tube (1) is the backbone of the invention. It is attached perpendicular at one end to the generic compound bow (10) by a connection plate (9) located just above the bow handle. Sheet 2/3, FIG. 2 provides a good view of the connection plate (9). The connection plate (9) is on the right side of the bow and has two holes in it countersunk on the outboard side to accept the two flat head screws (25). These two screws feed into two tapped holes in the generic compound bow (10) above the handle. It is on the right side because the invention is configured for a right handed archer.

The connection plate (9) male end slip-fits into the lever support arm tube (1) and the tube plus the rest of the assembly is held in place by two bolts, washers and nuts (21).

For storage purposes and also in the event an archer desires shooting the compound bow with no mechanical assistance, this connection plate/lever support arm tube design provides flexibility. Remove the two bolts, washers and nuts (21) and the invention is easily removed from the generic compound bow.

It is not the intent to distinguish between right handed archers or left handed archers and how the dominance of the left eye or right eye influences which of the two compound bow configurations the archer selects. This invention provides for either a right handed or left handed archer.

If the invention was configured for a left hand archer, the connection plate (9) would be located on the left side of the generic compound bow (10). The connection plate holes would be countersunk on the other (left) side of the connection plate (9) and secured to the generic compound bow (10) left side by the two flat head screws (25) fed into two tapped holes in the bow.

To complete a left hand configuration of this invention only one other change needs to be made. The generic quick release aid (12), when attached to the generic bow string (11), would be turned around 180 degrees so that the trigger would be exposed on the left side of the bow. The left handed archer would hold the left handed generic compound bow (10) in the right hand, rest the shoulder rest frame & pad (4) on the left shoulder and pull the generic quick release aid (12) with the left hand.

On the lever support arm tube (1) other end, away from the bow, is the pulley assembly (7) which is secured to the pulley assembly swivel holder (6) by a set screw (17). In turn, the pulley assembly swivel holder (6) slip fits into the lever support arm tube (1) and is secured in place by a set screw (16).

Sheet 2/3, FIG. 3 shows the pulley assembly (7) in three views. Included is a pulley assembly frame (26) and two pulley wheels (27) secured to the pulley assembly frame (26) by two rivets (23). A cotter pin (24) serves to trap the draw cable (13) in the pulley wheel grooves.

The draw cable (13) rides in the two pulley assembly (7) pulley wheel (27) grooves and is connected at one end to the lever arm (2) by an eyelet, washer & nut (20) using a loop and ferrule (22). It is connected at the other end to the generic quick release aid (12) also using a loop and ferrule (22). A cotter pin (24) traps the draw cable (13) in the two pulley assembly (27) pulley wheel grooves.

The pulley assembly (7) plus the pulley assembly swivel (6) have an essential adjustment feature. For the invention to operate at peak best mode efficiency and accuracy when the compound bow is being used, the generic quick release aid (12) holding the bow string (11) must be pulled by the draw cable (13) on a straight back parallel alignment relative to the lever support arm tube (1) axis.

To accomplish this alignment radially relative to the lever support arm tube (1) axis, the pulley assembly (7) holding the draw cable (13) can be slid back and forth in the pulley assembly swivel holder (6). The set screw (17) holds the setting.

To accomplish this alignment rotationally relative to the lever support arm tube (1) axis, the pulley assembly (6) swivel holder can be rotated. The set screw (16) holds the setting.

Once satisfied the generic quick release aid (12) is moving on a straight back parallel alignment relative to the lever support arm tube (1) axis, a minor adjustment must be made to the lever arm (2). The draw cable (13) being pulled by the lever arm (2) must not bind on the pulley assembly (7) pulleys. The lever arm (2) must be aligned with the pulley assembly (7) to assure the draw cable (13) is moving in the same plane as the lever support arm tube (1) axis. To accomplish this adjustment, rotate the lever arm (2) attached to the lever arm hinge sleeve (3) as required. The set screw (14) holds the setting.

Forward of the pulley assembly/pulley assembly swivel is located the shoulder rest adjustment sleeve (5) supporting the shoulder rest frame & pad (4). The shoulder rest frame & pad (4) rests on the archer's right shoulder, thus freeing up the archer's right hand to pull the generic quick release aid (12) trigger. For ergonomic purposes the shoulder rest frame & pad (4) is adjustable three ways to satisfy the physical requirements of the archer relative to the invention configuration. First, the shoulder rest frame & pad (4) can be adjusted radially by sliding it within the slot of the shoulder rest adjustment sleeve (5). The bolt, washer & wing nut (19) secures the adjustment. Also, the shoulder rest adjustment sleeve (5) can be adjusted rotationally relative to the lever support arm tube (1) axis. The set screw (15) secures the adjustment. Finally, the shoulder rest adjustment sleeve (5) can be slid back and forth along the lever support arm tube (1) axis. The set screw (15) secures the adjustment.

The four available invention adjustments have now been performed. The desired full draw length amount is established. The draw cable (13) is properly aligned with the lever arm (2) and the two pulley assembly (7) pulley wheels. The draw cable (13) is adjusted to draw on a line straight back parallel relative to the lever support arm tube (1) axis. The shoulder rest frame & pad (4) is ergonomically adjusted.

The operation of this invention begins with the archer engaging the generic quick release aid (12) in the nock location on the generic bow string (11). The trigger is facing to the archer's right. Next, the archer holds the outboard end of the lever arm (2) and forces it forward in the direction of the generic compound bow (10), pulling the draw cable (13) around the pulley assembly (7) pulley wheels, pulling the generic quick release aid (12) attached to the generic bow string (11). The second class lever mechanical advantage assists the archer in forcing the lever arm (2) forward in the direction of the generic compound bow (10). The lever arm (2) has now been pushed from the at rest position to the at full draw position. The generic bow string (11) is at full draw length. With the lever arm (2) now flat against the lever support arm tube (1), the archer moves the slip-lock ring (8) into place positioned between the two ridges on the outboard end of the lever arm (2). The bow string (11) is now locked at full draw length. The archer can nock an arrow, aim the bow and release the arrow. The generic compound bow (10) is held in the left hand and the invention is mounted on the right shoulder supported by the shoulder rest frame & pad (4). The trigger is pulled with the right hand.

What I claim is:

1. A mechanical full draw, hold, lock and arrow release device for compound bows comprising:

a lever support arm tube attached at one end perpendicular to a generic compound bow by a connection plate and having attached at the other end a pulley assembly in conjunction with a pulley assembly swivel, and in between also attached on the lever support arm tube is a shoulder rest frame and pad in conjunction with a shoulder rest adjustment sleeve;

a lever arm in conjunction with a lever arm hinge sleeve;

a slip-lock ring; and a draw cable connected to the lever arm, then back around the pulley assembly and connected forward to a generic quick release aid holding a generic bow string.

2. The mechanical device according to claim 1, wherein the mechanical device can be easily removed from the connection plate providing the archer with flexibility for use as well as storage.

3. The mechanical device according to claim 1, wherein the pulley assembly in conjunction with the pulley assembly swivel can be adjusted radially relative to and rotated around relative to the lever support arm tube axis for the purpose of establishing a bow string draw on a line straight back parallel relative to the lever support arm tube axis.

4. The mechanical device according to claim 1, wherein the shoulder rest frame & pad in conjunction with the shoulder rest adjustment sleeve can be rotated, slid parallel and adjusted radially relative to the axis of the lever support arm tube, thereby optimizing ergonomically the invention configuration to match the archer's physical requirements.

5. The mechanical device according to claim 1, wherein the lever arm in conjunction with the lever arm hinge sleeve can be rotated relative to the axis of the lever support arm tube for the purpose of eliminating draw cable binding on the pulley wheels and it can also be slid parallel relative to the axis of the lever support arm tube for the purpose of adjusting the generic compound bow string full draw length amount.

6. The mechanical device according to claim 1, wherein the draw cable is connected to the lever arm at an eyelet, and the eyelet can be relocated on the lever arm to change the mechanical advantage of the lever arm and also to adjust the generic bow string full draw length amount.

7. The mechanical device according to claim 1, wherein the slip-lock ring holds the lever arm in the at full draw position.

8. The mechanical device according to claim 1, wherein when forcing the lever arm forward in the generic compound bow's direction, the draw cable transfers the force applied to the lever arm back around the pulley assembly and again forward to the generic quick release aid attached to the generic bow string, ultimately holding the generic bow string in the at full draw position.

* * * * *